US006672816B2

(12) United States Patent
Mori et al.

(10) Patent No.: US 6,672,816 B2
(45) Date of Patent: Jan. 6, 2004

(54) SIMPLIFIED BOOKBINDING DEVICE FOR TWIN-RING

(75) Inventors: Makoto Mori, Tokyo (JP); Hideyuki Suzuki, Tokyo (JP); Tomoyoshi Nakamura, Tokyo (JP)

(73) Assignee: Carl Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/200,228

(22) Filed: Jul. 23, 2002

(65) Prior Publication Data

US 2003/0228206 A1 Dec. 11, 2003

(30) Foreign Application Priority Data

Jun. 5, 2002 (JP) ..... 2002-164229

(51) Int. Cl.[7] ..... B42B 5/08
(52) U.S. Cl. ..... 412/38
(58) Field of Search ..... 412/38, 39, 33, 412/40, 9, 11, 1

(56) References Cited

U.S. PATENT DOCUMENTS 4,874,279 A * 10/1989 Pfaffle ..... 412/39
6,059,505 A * 5/2000 Wang ..... 412/39
6,062,792 A * 5/2000 Garrity ..... 412/39
6,074,151 A * 6/2000 Pas ..... 412/38

* cited by examiner

*Primary Examiner*—Derris H. Banks
*Assistant Examiner*—Jamila Williams
(74) *Attorney, Agent, or Firm*—Oliff & Berridge, PLC

(57) ABSTRACT

There is provided a bookbinding device for binding a plurality of sheets together by pressure-deforming a twin-ring inserted through each of holes in the sheets, comprising: an anvil; a press section for pressurizing the twin-ring between it and the anvil; a power transmission section for sliding the,press section; and an operating section for sliding the power transmission section, wherein the power transmission section is moved along the length of the twin-ring; and the press section is moved in a direction perpendicular to the length of the twin-ring. The rotational motion of the operating section is converted to a sliding motion of the power transmission section by the engagement of the rack and pinion and the sliding directions of the power transmission section and the press section are converted at respective inclined planes.

4 Claims, 14 Drawing Sheets

SIMPLIFIED BOOKBINDING DEVICE FOR TWIN-RING

BACKGROUND OF THE INVENTION

1. Field of the Invention

The present invention relates to a simplified bookbinding device for binding a plurality of sheets using a twin-ring.

2. Description of the Related Art

Various bookbinding techniques are used for binding a plurality of sheets to one book. Among the bookbinding techniques which are well known are thread binding using a machine, threadless binding by gumming the back with an adhesive, wire-stitch binding with staples of a stapler, spiral binding with a spiral coil, and twin-ring binding (double-ring binding) with a wire called a twin-ring, a double-ring, or a double-loop ring.

There are various types of bookbinding techniques, as described above. However, when the bound book is opened at 360 degrees, the thread binding, the threadless binding, and the wire-stitch binding are not employed, but the spiral binding or the twin-ring binding are mainly adopted. However, the spiral binding has such a drawback that the left and right pages have slight vertical displacement when opened at 360 degrees as well as advantages that it is cheap and superior in durability because a metallic wire is used. When such vertical displacement is not desired, the twin-ring binding is employed. Although the twin-ring used as a binding device for the twin-ring binding is in general more delicate and expensive than the spiral ring, it has also an advantage of being suitable for storing long-term-use documents because of its unique configuration in which two wires are inserted through one hole. Therefore, the demand for the twin-ring binding is greatly improved.

Typically, the twin-ring is formed in such a way that an iron wire coated with nylon is formed in a unique C-shape in section with a twin-ring forming machine and is wound around a bobbin. At the time of bookbinding, the bobbin, around which the twin-ring is wound, is attached to a twin-ring binding device, and a twin-ring of necessary length is pulled out for use.

Referring now to FIGS. 13A to 13C and 14, a conventional twin-ring binding will be specifically described. FIGS. 13A is a perspective view of a twin-ring 1 before binding operation; FIG. 13B is a sectional view of the twin-ring 1, taken on line b—b; and FIG. 13C is a sectional view of the twin-ring 1 after the section has been pressurized into a substantial O shape. FIG. 14 is a perspective view of the twin-ring 1 after the binding operation.

As shown in FIG. 13A, the twin-ring 1 is formed by alternately connecting a large number of U-shaped or V-shaped binding pieces 2 and connecting pieces 3, which are made of one wire. As shown in FIG. 14, the binding pieces 2 are each inserted through holes 8 punched in the side of sheets 9 and the connecting pieces 3 connect between the holes 8 in the sheets 9. Before binding, the twin-ring 1 has a substantially C shape in section in which two semicircular-arch-shaped parts are connected at a bend portion 5, as shown in FIG. 13B. At that time, the binding pieces 2 are opened (gap) with respect to ends 4, thus allowing the insertion of the sheets 9. At the time of binding, the twin-ring 1 is pressurized by a predetermined force F to bring the end of each binding piece 2 and the end 4 into close to each other into a ring shape at the bend portion 5 (refer to FIG. 14). The twin-ring 1, at this time, is deformed (bent) such that the two semicircular-arch-shaped parts form one circle in section, as shown in FIG. 13C.

The wire for the twin-ring 1 is selected depending on the thickness of the sheets 9 to be bound (refer to FIG. 14). Although the wire is as small as about 1 mm in diameter, it requires a substantial pressure to deform, in section, the two wires inserted through the holes 8 in the sheets 9 from the shape shown in FIG. 13B to the shape shown in FIG. 13C. Therefore, conventionally, for twin-ring binding, relatively large exclusive-use twin-ring binding devices are used which incorporate a punching operation for punching a plurality of holes in the side of the sheets. However, since such binding devices occupy too much space for installation, it is difficult for individuals to perform bookbinding with ease, thus growing a demand for a simplified binding device for easily performing twin-ring binding.

SUMMARY OF THE INVENTION

In view of the state of the art set forth above, it is an object of the present invention to provide a simplified bookbinding device for a twin-ring, which provides a binding mechanism separate from a punching operation, downsizes the device for decreasing the space for installation, and simplifies the operation, thereby allowing individuals to easily perform bookbinding using the twin-ring.

In order to achieve the above object, according to a first aspect of the present invention, there is provided a bookbinding device used when stacking a plurality of sheets each having a plurality of holes punched in advance, and binding the plurality of sheets together by inserting a twin-ring through each of the holes and deforming the twin-ring by pressure, comprising an anvil; a press section for pressurizing the twin-ring between it and the anvil; a power transmission section for sliding the press section; and an operating section for sliding the power transmission section, wherein the power transmission section is moved along the length of the twin-ring; and the press section is moved in a direction perpendicular to the length of the twin-ring.

With such a configuration, the bookbinding device can be formed small in its entirety, which is long in length along the length of the twin-ring and is short in length perpendicular to the length of the twin-ring, thus saving space for installation.

According to the first aspect of the present invention, the bookbinding device further comprises an adjusting section for determining in steps the sliding start position of the power transmission section.

With such a configuration, when twin-rings of various diameters are deformed by pressure, a suitable compression amount can be determined in steps so as to prevent excess compression in each case.

According to the first aspect of the present invention, the bookbinding device further comprises a retaining section for retaining the twin-ring to the substantially full length of the side of the main body.

With such a configuration, the twin-ring can quickly be inserted through the holes in the sheets by retaining the twin-ring over the substantially full length.

While the simplified bookbinding device according to the present invention is principally configured as described above, when the motion of the operating section is converted to a sliding motion of the power transmission section, the power transmission mechanism is not limited to a rack and pinion, but a link mechanism, a cam mechanism, or other gear mechanisms may be used for transmitting power to the operating section. Also, the rotating direction of the operating section is not limited to the direction along the length of the twin-ring, but may operate the binding mechanism by a small force from another direction.

DESCRIPTION OF THE PREFERRED EMBODIMENT

A preferred embodiment of the present invention will be described hereinbelow with reference to the attached drawings.

Figure 1:
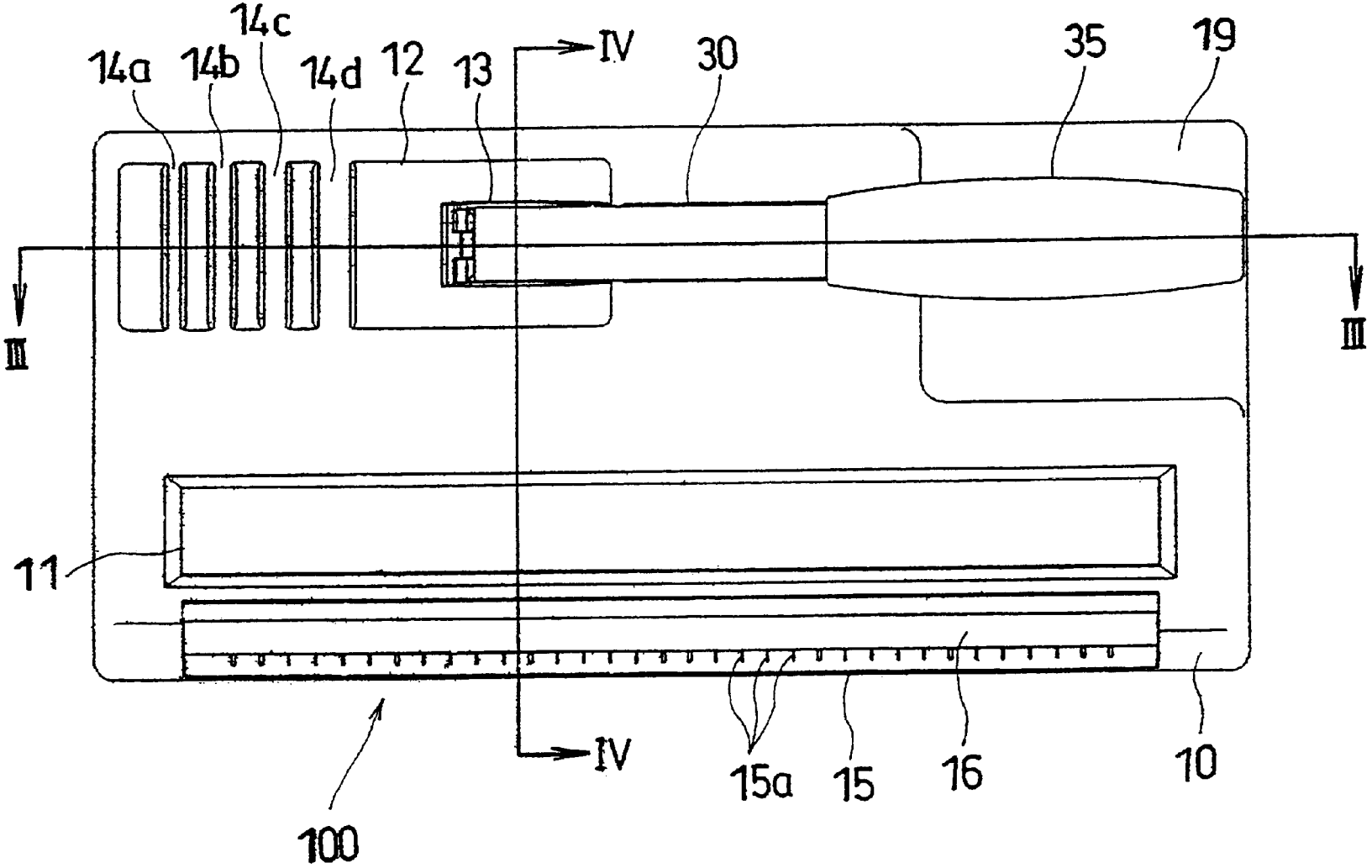
FIG. 1 is a plan view of a bookbinding device according to an embodiment of the present invention.
Figure 2:
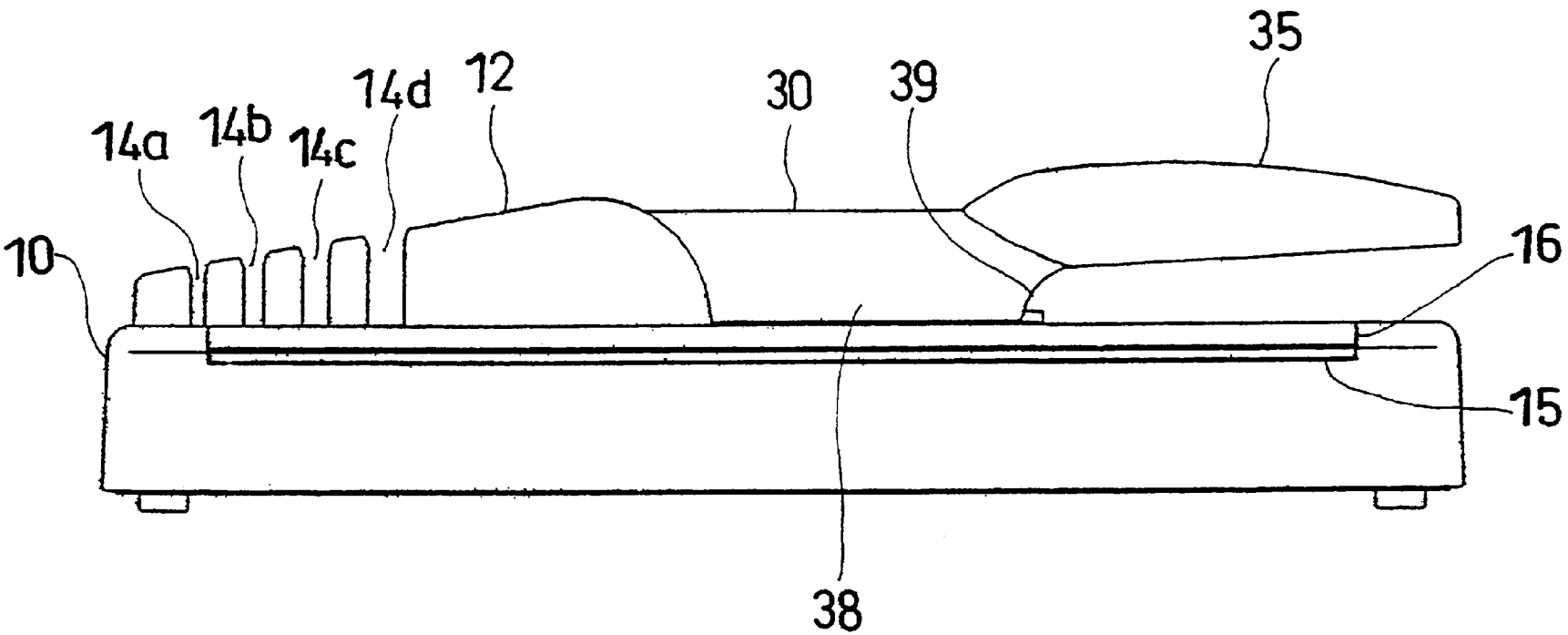
FIG. 2 is a side view of the bookbinding device shown in FIG. 1.
Figure 3:
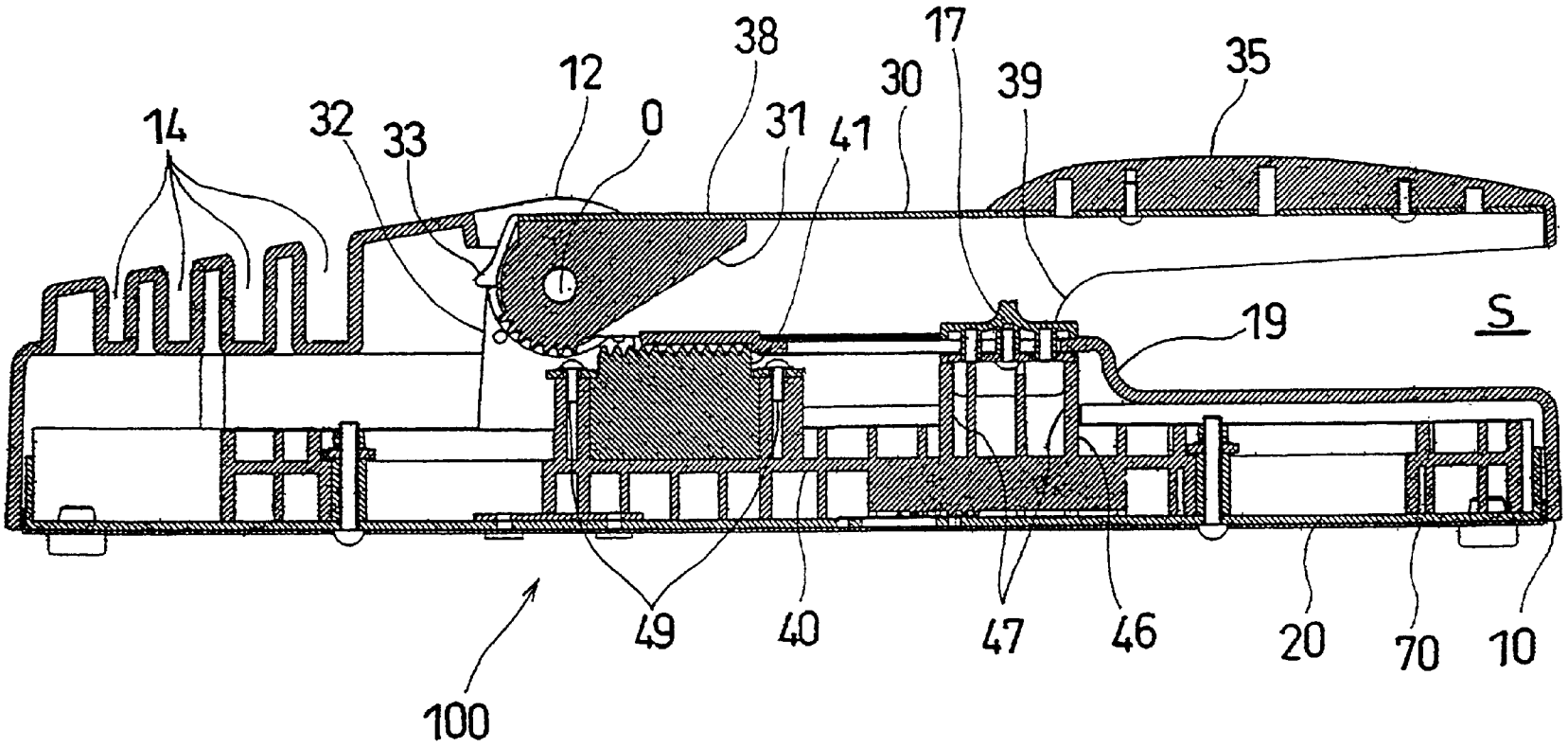
FIG. 3 is a sectional view of the bookbinding device in FIG. 1, taken on line III—III.
Figure 4:
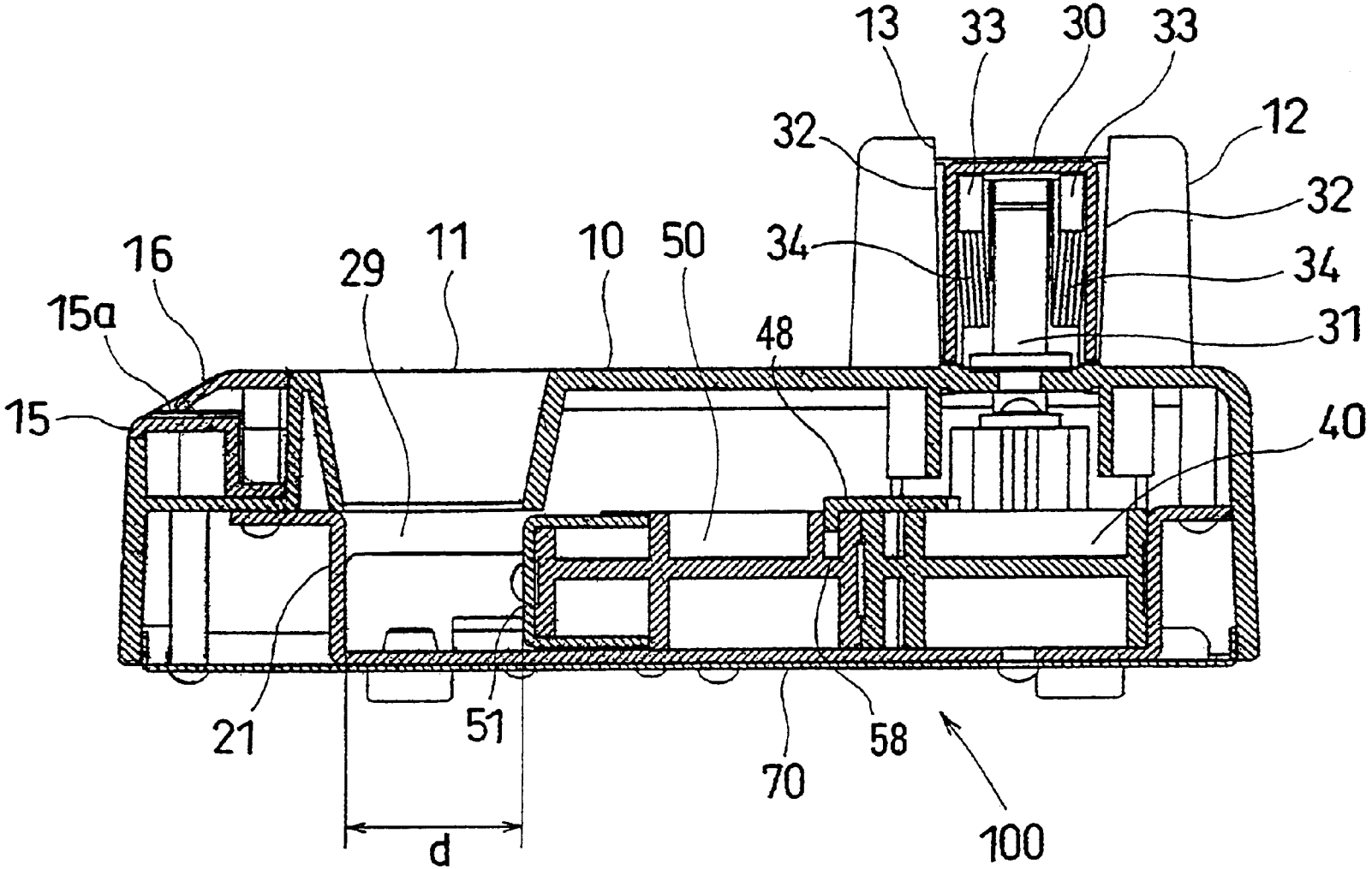
FIG. 4 is a sectional view of the bookbinding device in FIG. 1, taken on line IV—IV.

Referring initially to FIGS. 1 to 7, a simplified bookbinding device 100 for a twin-ring according to an embodiment of the present invention will be described. FIG. 1 is a plan view of the bookbinding device 100 according to the embodiment of the present invention. FIG. 2 is a side view of the bookbinding device shown in FIG. 1; FIG. 3 is a sectional view of the bookbinding device in FIG. 1, taken on line III—III; and FIG. 4 is a sectional view of the bookbinding device in FIG. 1, taken on line IV—IV.

As shown in the drawings, the bookbinding device 100 includes a substantially rectangular main body, which is configured to fit a lid 10 (refer to FIGS. 2 and 3) on a base 20 (refer to FIG. 3). Preferably, the bookbinding device 100 is used to bind A4-size sheets, and accordingly, the length thereof is extended longitudinally over the full length of a twin-ring suitable for binding the A4-size sheets. The longitudinal length of the bookbinding device 100 may arbitrarily be modified as appropriate to bind sheets other than the A4-size sheets.

In the case of twin-ring binding, while a twin-ring 1 used as a binding device is, in general, more precise and expensive than a spiral ring, it has a drawback that the twin-ring 1 that failed binding operation cannot normally be reused. This is because the failed twin-ring 1 is plastically deformed into an undesirable shape and it is not always economical to restore to the initial shape and perform binding operation again. Therefore, it is preferable that the twin-ring bookbinding be performed through appropriate preparatory steps so that no erroneous bookbinding operation is performed. In the preferred embodiment of the present invention, the lid 10 of the bookbinding device 100 includes a means for selecting a most suitable twin-ring 1 for sheets to be bound, a means for inserting the selected twin-ring 1 through sheets 9, a means for determining a suitable compression amount for various types of twin-rings 1, and a means for arranging the twin-ring 1 inserted through the sheets 9 to be pressurized in a proper direction. Therefore, paging disorder and so on may not occur during bookbinding operation, thus decreasing wasteful use of the twin-ring 1.

More specifically, the lid 10 of the bookbinding device 100 includes grooves (measuring sections) 14*a* to 14*d* (refer to FIG. 1) for quickly measuring the number of sheets to determine the thickness of the plurality of sheets 9 for every grooves 14*a* to 14*d* and to select the twin-ring 1 suitable for bookbinding operation. This is because it is preferable to vary the diameter of the twin-ring 1 to be used in such a manner that a small twin-ring 1 is selected for a small thickness and a large twin-ring 1 is selected for a large thickness depending on the number (thickness) of the sheets to be bound. The embodiment of the present invention includes a raised portion 12 on the main body 10, in which the plurality of grooves 14*a* to 14*d* increasing in spacing therebetween step by step is formed, as shown in FIG. 2. By inserting the plurality of sheets 9 in piles into the grooves 14*a* to 14*d*, the thickness of the sheets 9 to be bound is classified to the most suitable groove among the grooves 14*a* to 14*d* prepared in advance. According to the classification result, a suitable twin-ring 1 for bookbinding operation can be determined.

Figure 13A:
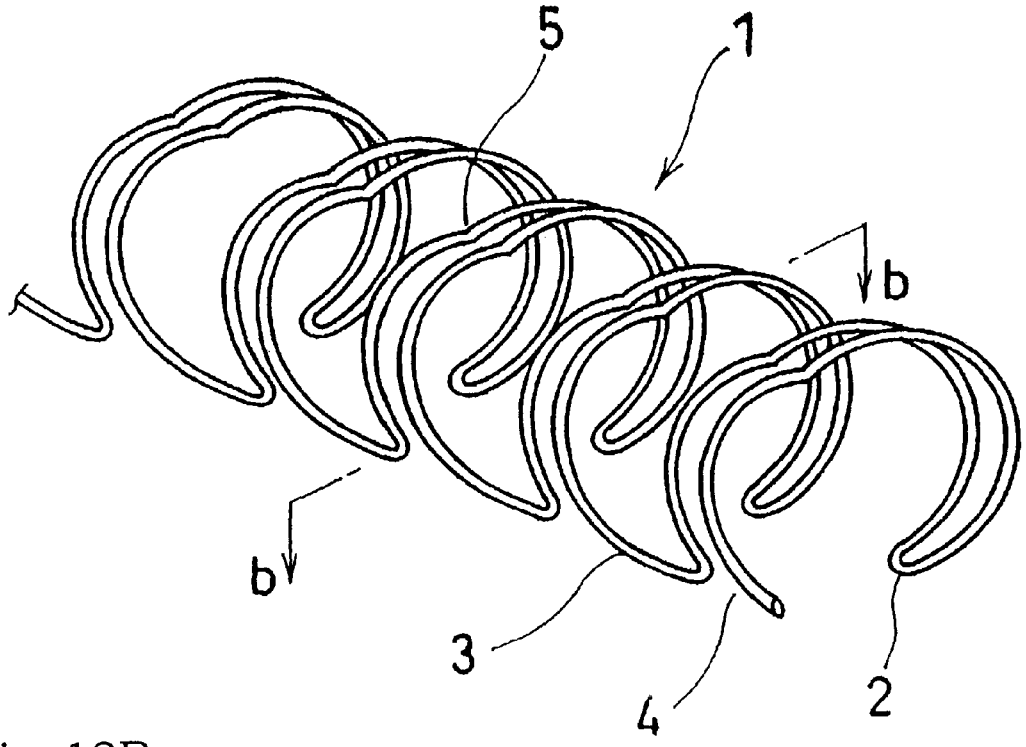
FIGS. 13A to 13C are a diagram of a twin-ring before bookbinding operation, a sectional view of the twin-ring, taken on line b—b, and a sectional view of the twin-ring after pressurization, respectively.
Figure 13B:
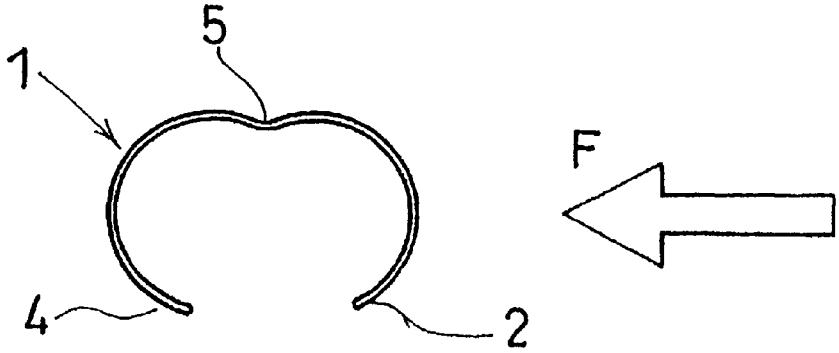
Figure 13C:
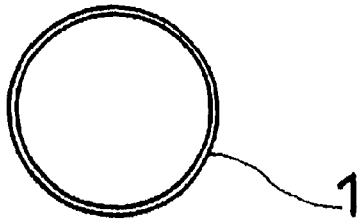

As shown in FIG. 1, retaining sections (ring grips) 15 and 16 are provided on the side of the bookbinding device 100 for retaining (hooking) the twin-ring 1 to the side of the lid 10. Preferably, the retaining sections are configured of the first retaining section 15 and the second retaining section 16. The first retaining section 15 has a comb-like section 15*a* (refer to FIG. 1) corresponding to the shape of the twin-ring 1 which alternately connecting a large number of binding pieces 2 and connecting pieces 3 (refer to FIG. 13A to 13C), on which the twin-ring 1 is positioned. The second retaining section 16 hooks the twin-ring 1 inserted onto the first retaining section 15 from above and retains it on the side of the lid 10 (refer to FIG. 5B). Preferably, the twin-ring 1 is retained over the full longitudinal length.

Figure 5A:
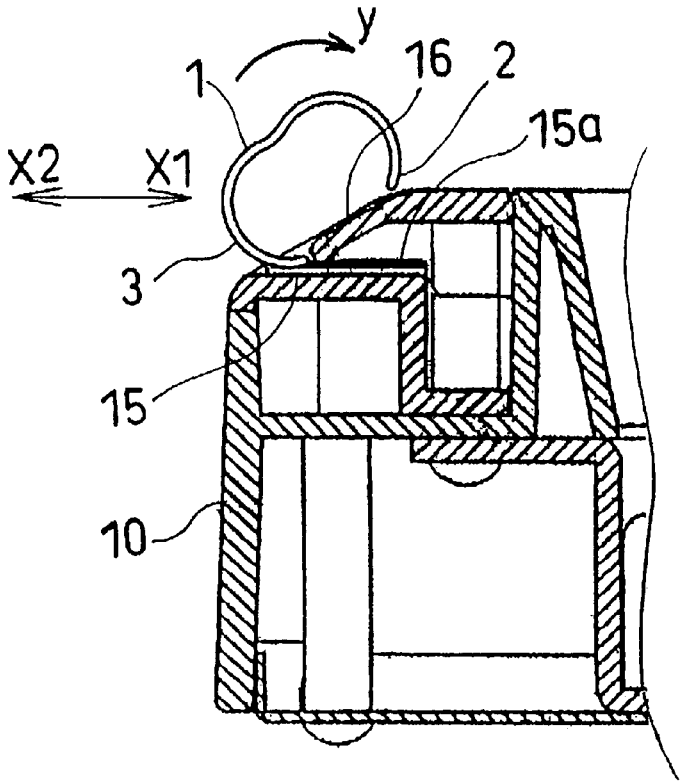
FIGS. 5A and 5B are diagrams showing a state immediately before a twin-ring is hooked in a retaining section on the side of the bookbinding device and a state immediately thereafter, respectively.
Figure 5B:
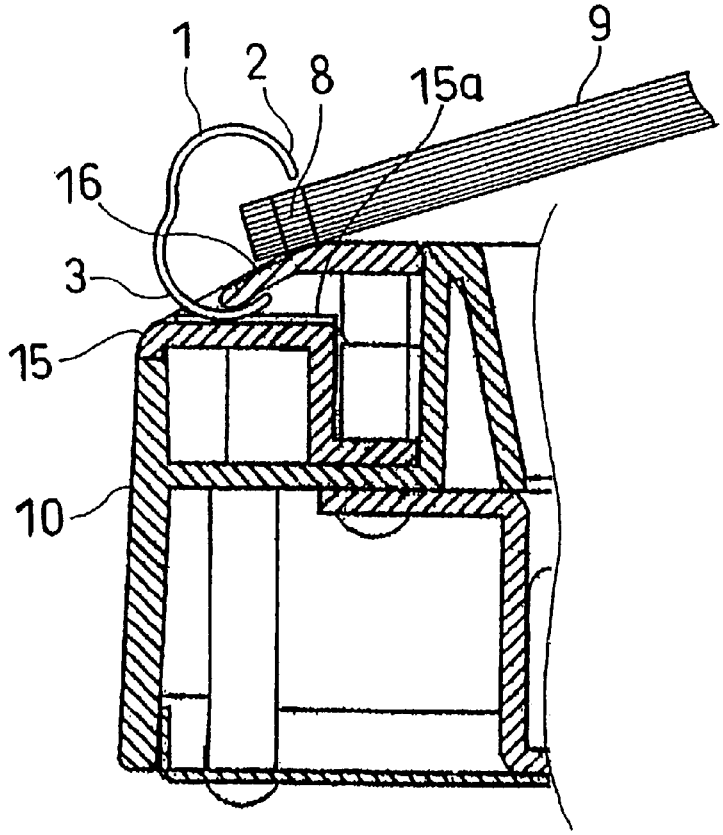

Referring now to FIGS. 5A and 5B, a means for retaining the twin-ring 1 to the first and second retaining sections 15 and 16 will be specifically described. FIGS. 5A and 5B are partially enlarged views of the bookbinding device 100 shown in FIG. 4. FIG. 5A shows a state immediately before the twin-ring 1 is retained to the retaining sections 15 and 16, wherein the second retaining section 16 is inclined with respect to the first retaining section 15. Therefore, in order to insert the twin-ring 1 between the first and second retaining sections 15 and 16, the binding pieces 2 are tilted toward the second retaining section 16 (refer to reference symbol y) while the connecting pieces 3 of the twin-ring 1 are positioned to the comb-like section 15*a* (refer to FIG. 1) of the first retaining section 15 and the connecting pieces 3 are then pushed between the first retaining section 15 and the second retaining section 16 for insertion (refer to reference symbol x1). FIG. 5B shows a state in which the twin-ring 1 inserted between the first retaining section 15 and second retaining section 16 is brought in an upright position to form a gap between the binding piece 2 and the second retaining section 16, between which the sheets 9 are inserted. When the twin-ring 1 is brought in the upright position, the curved connecting piece 3 (refer to FIG. 13A) and the end of the second retaining section 16 are engaged with each other, thereby preventing the twin-ring 1 from being further tilted frontward (in the opposite direction of the reference symbol y). Therefore, the twin-ring 1 does not come off in an upright position and the binding pieces 2 of the twin-ring 1 can quickly be inserted through holes 8 of the sheets 9. In order to disengage the twin-ring 1 again from the lid 10 of the bookbinding device 100, the twin-ring 1 is tilted in the direction shown by the reference symbol y in FIG. 5A and is slid in the direction shown by the reference symbol x2 in FIG. 5A.

Furthermore, the lid 10 is provided with a tab (sliding section) 17 (refer to FIG. 3) for pressurizing the twin-ring 1 of selected type by a suitable force. Since the twin-ring 1 varies in size in correspondence with the thickness of the sheets 9 to be bound, as described above, the above pressuring means is provided to determine a suitable compression amount so as to prevent excess compression for each twin-ring 1 of various sizes. Such operation can easily be performed by sliding the tab 17 provided on the main body 10, which will be specifically described later.

Figure 6:
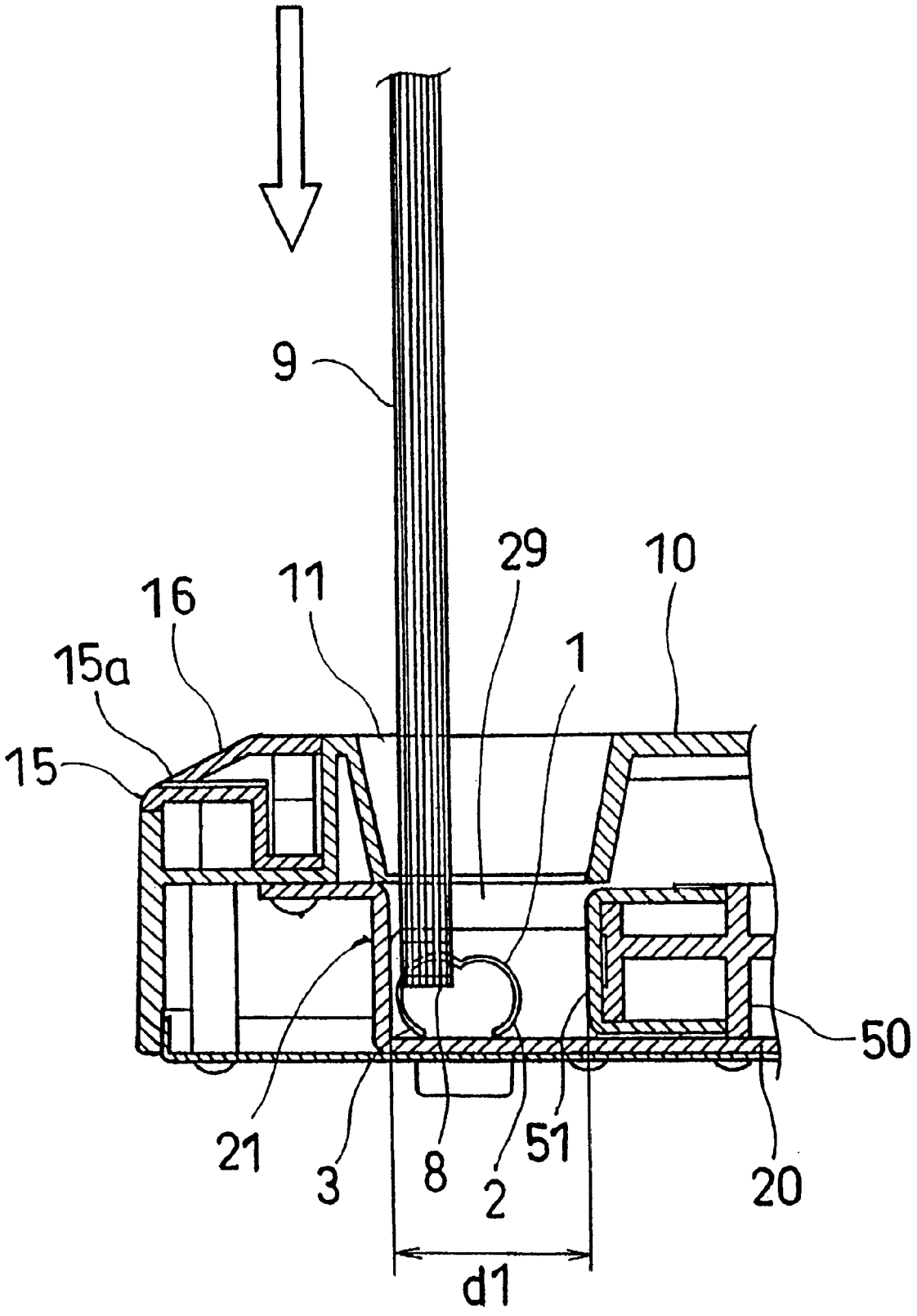
FIG. 6 is an a state before bookbinding operation in which the twin-ring inserted through each hole of sheets is inserted into an opening of a bookbinding section.

In order to pressure-deform the twin-ring 1, as shown in FIG. 6, it is necessary to arrange the binding pieces 2 and the connecting pieces 3 to face an anvil 21, to bring the connecting pieces 3 of the twin-ring 1 into contact with the side of the anvil 21, and to pressurize the binding pieces 2 side. Accordingly, in the embodiment of the present invention, the lid 10 is provided with a portion (not shown) for calling attention so that the twin-ring 1 is pressurized in a proper direction. For example, an instruction indicating a proper direction is provided at an easy-to-view position near an opening 11 at the upper part of the main body along with the drawing of the twin-ring 1.

Figure 7:
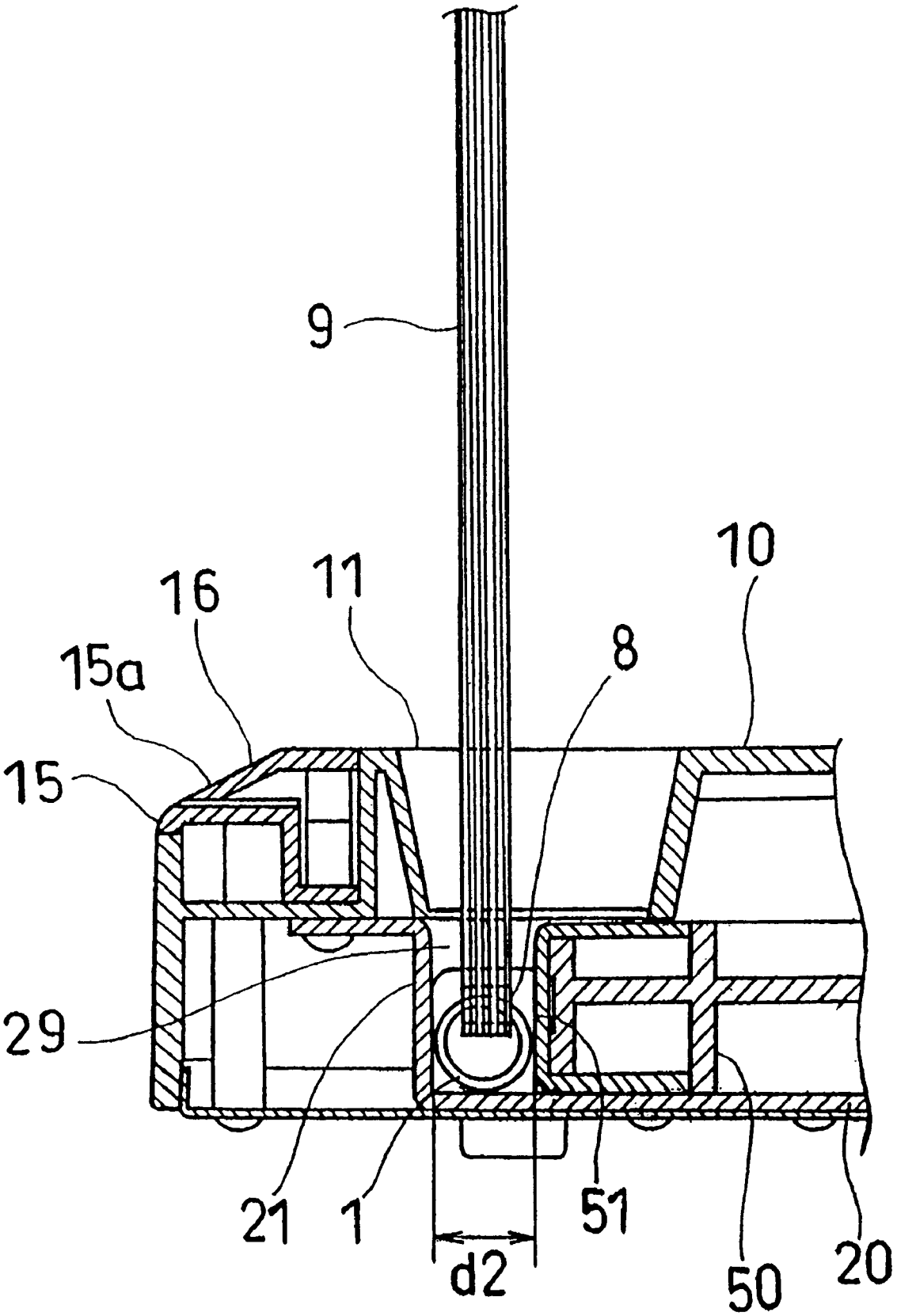
FIG. 7 is a diagram showing a state after bookbinding operation in which the twin-ring is pressure-deformed from the state shown in FIG. 6.

Through the above steps, the preliminary steps of twin-ring bookbinding are completed using the bookbinding device 100 according to the embodiment of the invention. As shown in FIG. 6, the twin-ring 1 inserted through the sheets 9 is inserted through the opening 11 provided in the main body of the bookbinding device 100 and is positioned in a groove 29. The binding pieces 2 and the connecting pieces 3 of the twin-ring 1 are brought into contact with the unmoving anvil (contact portion) 21 provided in the groove 29 and the binding pieces 2 is arranged on a press section 50 side for pressure contact. As shown in FIG. 7, the press section 50 is slid using a bookbinding mechanism 90 (refer to FIGS. 8 and 9) to pressurize the twin-ring 1 with a press face 51 provided on the side of the press section 50, thereby deforming the section of the twin-ring 1 from a shape shown in FIG. 6 or FIG. 13B to a shape shown in FIG. 7 or FIG. 13C.

Figure 8:
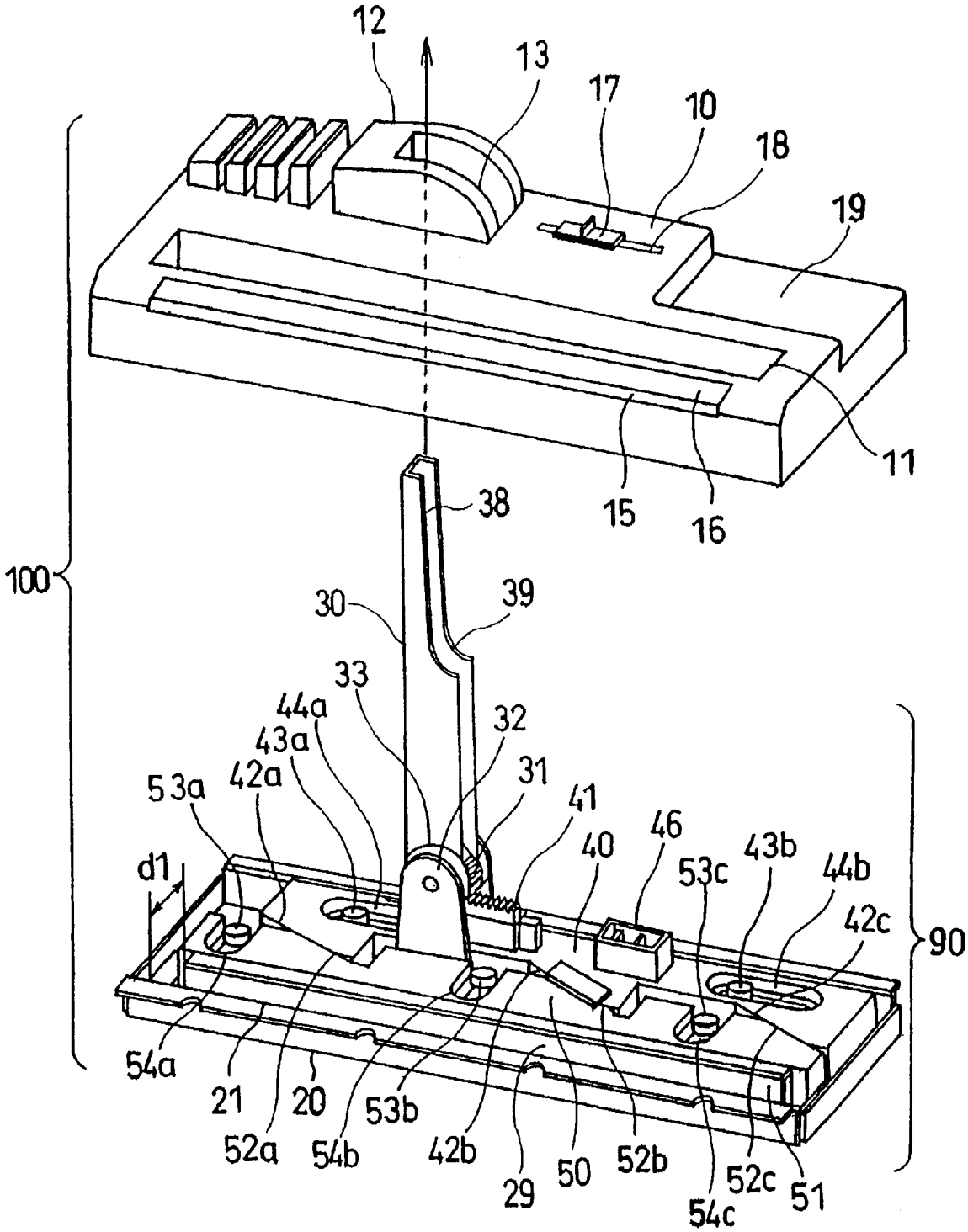
FIG. 8 is an exploded perspective view showing a state before bookbinding operation of a bookbinding mechanism in the bookbinding device shown in FIG. 1.
Figure 9:
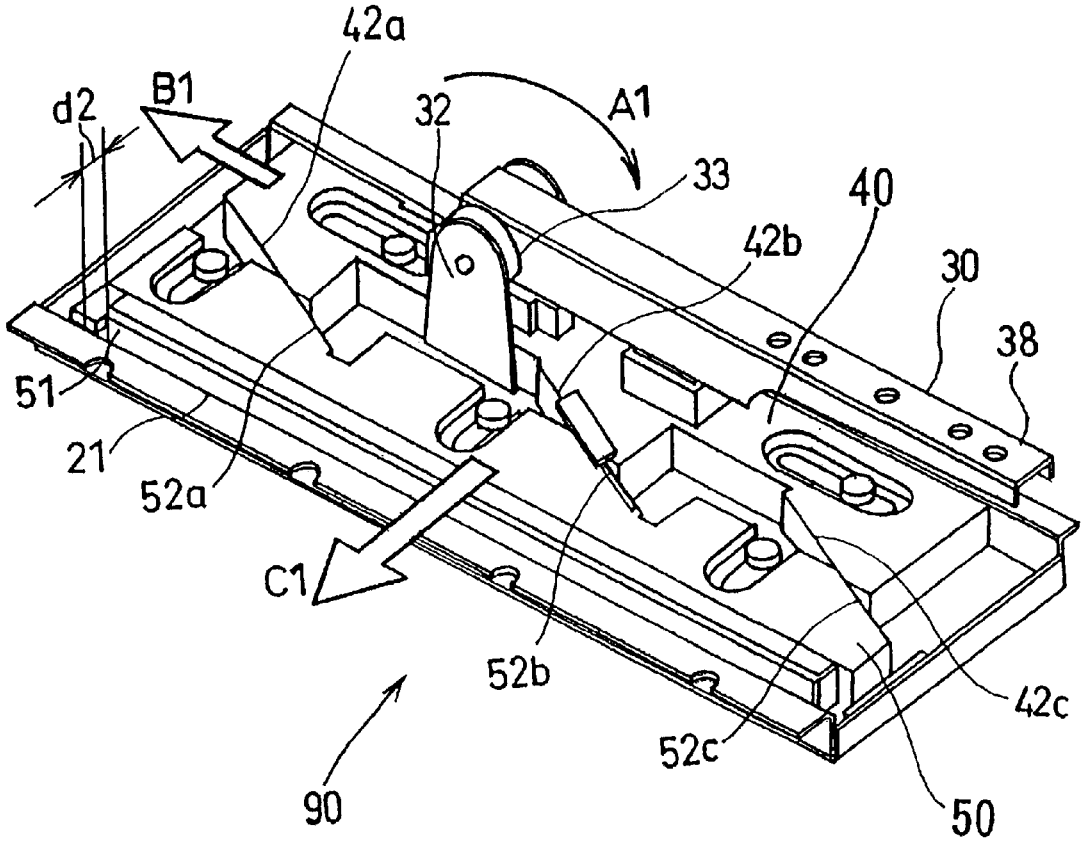
FIG. 9 is a perspective view showing a state after the bookbinding operation of the bookbinding mechanism shown in FIG. 8.

Referring now to FIGS. 8 to 11, the bookbinding mechanism 90 provided in the bookbinding device 100 for sliding the press section 50 will be described with reference to FIGS. 1 to 7. FIG. 8 is an exploded perspective view of the bookbinding mechanism 90 in the bookbinding device 100 with the lid 10-moved upward from the bookbinding device 100. FIG. 9 is a perspective view showing a state after the bookbinding operation, of the bookbinding mechanism 90 shown in FIG. 8. FIGS. 10A to 10C are diagrams showing the correlation between a power transmission section 40 and the press section (pressure contact section) 50 (refer to FIG. 4), which will be specifically discussed later.

As shown in FIG. 8, in the preferred embodiment of the present invention, the bookbinding mechanism 90 is composed of at least an operating section 30 (refer to FIGS. 1 and 2), the power transmission section (first slide section) 40, and the press section (second slide section) 50. The operating section 30 is manually rotated in a predetermined direction to simultaneously convert the rotational motion to sliding motions of the two slide sections 40 and 50 in the main body. The press section (second slide section) 50 is slid in a substantially vertical direction relative to the length of the twin-ring 1 to perform the bookbinding operation (refer to FIGS. 6 and 7). The power transmission section (first slide section) 40 transmits power between the operating section 30 and the press section (second slide section) 50 so as to slide the press section (second slide section) 50 in a suitable direction. Preferably, the power transmission section (first slide section) 40 is configured to slide along the length of the twin-ring 1 of the bookbinding device 100, wherein the bookbinding device 100 is formed compact such that it is long along the length of the twin-ring 1 and is short in length perpendicular to the length of the twin-ring 1.

The operating section 30, the power transmission section 40, and the press section 50 will be described in sequence.

As shown in FIG. 2, the operating section 30 includes an arm 38 extending along the length thereof, a handle 35 provided at one end of the arm 38, and a pedestal (support base) 32 (refer to FIG. 3) journaling the other end of the arm 38. Although the handle 35 may be formed in any shape, it is preferable to have a suitable shape to be handled by hand. In order to facilitate the grip operation for the handle 35, the handle 35 is arranged slightly above the arm 38, as shown by reference numeral 39 in FIG. 3, and a recess 19 (refer to FIG. 8) is formed in the upper part of the lid 10 to provide a spacing S (refer to FIG. 3) for grip operation between the handle 35 and the recess 19.

In the illustrated embodiment, the pedestal 32 is secured to the base 20 for journaling a rotating shaft O shown in FIG. 3. The arm 38 has a hole at the base, through which the rotating shaft O is inserted, and has a spacer 33, shown in FIG. 8, and an elastic member (spring) 34, shown in FIG. 4, interposed between it and the side of the pedestal 32, and is thus configured rotatable around the rotating shaft O. Furthermore, the embodiment of the present invention has a first power-transmission section 31, which is preferably a gear wheel (pinion), at the base of the arm 38 (refer to FIG. 3). The teeth of the gear wheel 31, however, are not necessarily formed over the full length but are sufficient to be formed only in an area necessary for operation, as shown in FIG. 3. The teeth of the gear wheel 31 are used not only for power transmission but also for determining the compression amount of the twin-ring 1.

The arm 38 is extended longitudinally to apply leverage between the handle 35 and the rotating shaft O provided at the pedestal 32, thereby rotating the gear wheel 31 at the base of the arm 38 by a lower force. However, it is preferable to form the arm 38 not exceeding the length of the bookbinding device 100 for making the bookbinding device 100 more compact.

As shown in FIGS. 3 and 8, the power transmission section 40 provided in the main body of the bookbinding device 100 includes a second power-transmission section 41 at the upper part thereof for transmitting power acing in a pair with the first power-transmission section 31. The first power-transmission section 31 and the second power-transmission section 41 transmit power therebetween to convert the motion of the operating section 30 to a sliding motion of the power transmission section (first slide section) 40. Preferably, the second power-transmission section 41 is a rack 41 coming into engagement with the gear wheel 31 at the base of the arm 38. However, in the embodiment shown in FIG. 3, the power transmission section 40 is in a backward position, so that the rack 41 does not come in engagement with the gear wheel 31. Also, in the illustrated embodiment, the power transmission section 40 has the separate rack 41 attached thereon using screws 49 and washers. Preferably, the gear wheel 31 provided at the base of the arm 38 and the rack 41 provided at the power transmission section 40 are configured to be brought into engagement with each other using spur gears having the same module, the same pressure angle, and the same torsion angle. Therefore, the power transmission section 40 integrated with the rack 41 is slid in such a way that the operating section 30 is rotated around the rotating shaft O to rotate the gear wheel 31 at the base of the arm 38, thereby starting the sliding motion of the rack 41 in engagement with the gear wheel 31.

The assembly of the first power-transmission section 31 and the second power-transmission section 41, however, is not limited to the aforesaid rack and pinion, but may be configured using a link mechanism including a slider, a cam mechanism, or another gear mechanism.

As stated above, in the twin-ring bookbinding, it is preferable to vary the pressure required for the pressure deformation for every twin-rings 1 of different diameters. More specifically, while, when thin sheets are bound, a small twin-ring 1 is used, it is preferable to increase the sliding distance of the power transmission section 40 for determining the moving distance of the press section 50. On the other hand, while, when thick sheets are bound, larger twin-ring 1 is used, it is preferable to decrease the sliding distance of the power transmission section 40.

Figure 11:
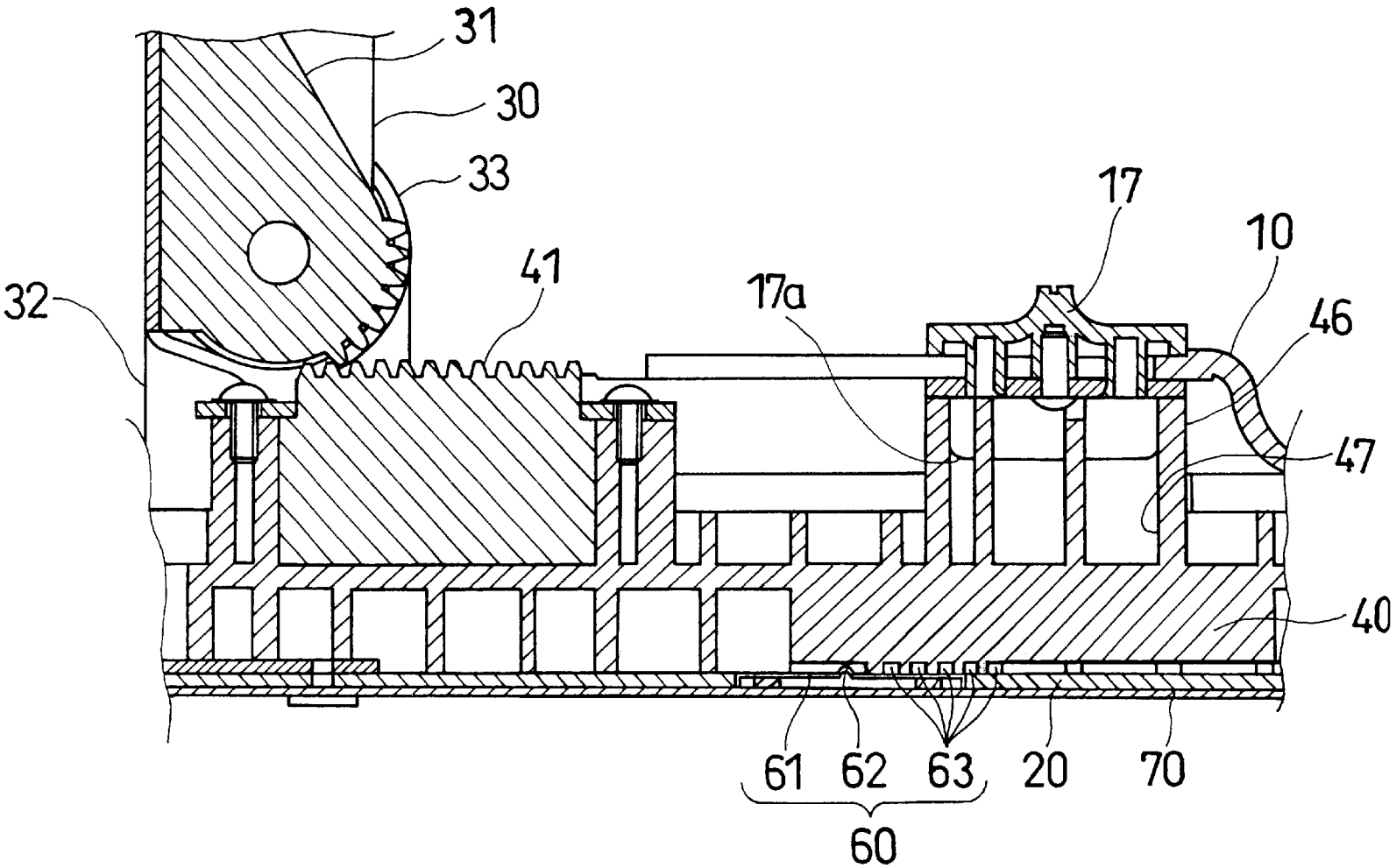
FIG. 11 is an enlarged view of essential parts of an adjusting section under the power transmission section shown in FIG. 3.

Accordingly, the embodiment of the present invention includes an adjusting section 60, as shown in FIG. 11, to engage a protrusion (convex portion) 62 with either of a plurality of grooves (concave portions) 63, thereby determining a sliding start position (or a sliding distance) of the power transmission section 40 in steps to determine an engaging position (engaging amount) between the aforesaid gear wheel 31 and the rack 41 in steps. FIG. 11 is an enlarged view of essential parts of the adjusting section shown in FIG. 3.

Figure 12:
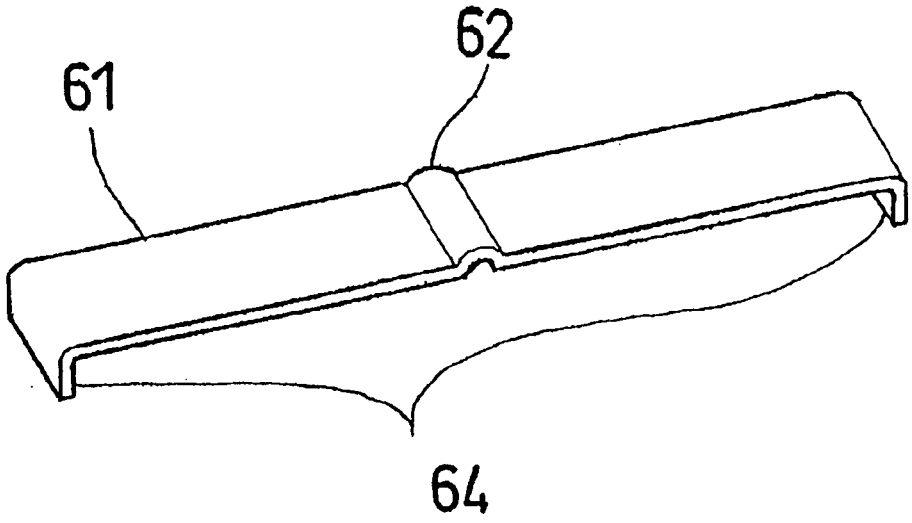
FIG. 12 is an enlarged perspective view of a leaf spring shown in FIG. 11.

More specifically, the adjusting section (positioning section) 60 is configured such that the bookbinding device 100 includes a leaf spring 61 (refer to FIG. 12) at the bottom thereof, on which the protrusion (convex portion) 62 is formed (bent), and the protrusion 62 is fitted into either of the plurality of grooves (concave portions) 63 under the power transmission section 40. Also, a groove (slot) 18 (refer to FIG. 8) is provided in the lid 10 to determine the position of the adjusting section 60 in steps. Furthermore, a tab (sliding section) 17 is slidably provided along the groove 18 and an end 17*a* of the tab 17 is brought into engagement with the inner face 47 (not shown) of an engaging section 46 integrated with the power transmission section 40. Also, a gauge (not shown) is provided adjacent to the groove 18 for positioning the tab 17 in steps so as to correspond to at least the number of the types of the twin-ring 1 distinguished by the grooves 14*a* to 14*d*.

Accordingly, by operating the tab 17 in steps, the power transmission section 40 moved along with the tab 17 brings, at the bottom, any one of the plurality of grooves 63 into engagement with the protrusion 62 of the leaf spring 61, thus determining the sliding start position of the power transmission section 40 so as not to be disengaged easily. However, the leaf spring 61 has flexibility, is attached to the base 20 at both ends 64, shown in FIG. 12 (refer to FIG. 11), and has the protrusion 62 at the center of the main body. The leaf spring 61 is configured, when a force stronger than a predetermined force is applied to the protrusion 62, to disengage the protrusion 62 from the groove 63. Thus, when the sliding start position of the power transmission section 40 is determined in steps by operating the tab 17, as described above, the engaging distance of the gear wheel 31 to be engaged with the rack 41 is determined in conjunction therewith, thereby determining the compression amount of the twin-ring 1.

The power transmission section 40 is slid from a predetermined sliding position using the adjusting section 60, as described above. According to the embodiment of the present invention, as stated above, the sliding direction of the power transmission section 40 is changed once to pressure-deform the twin-ring 1 accommodated in the groove 29 with the separate press section 50.

In other words, according to the embodiment of the present invention, the entire bookbinding device 100 is configured more compact and the arm 38 is extended along the length of the bookbinding device 100 to slide the power transmission section 40 by a lower force using the principal of leverage. In this case, since the pitch surface of the rack 41 is extended along the length of the bookbinding device 100, the power transmission section 40 integrated with the rack 41 is moved along the length of the bookbinding device 100. However, for the twin-ring bookbinding, it is necessary to pressurize the twin-ring 1 extending along the length of the bookbinding device 100 in a perpendicular direction thereto. The embodiment of the present invention includes inclined planes (flat cams) 42*a*, 42*b*, and 42*c* (refer to FIGS. 8, 9, and 10A to 10B) on the side of the power transmission section 40 moving along with the rack 41, and inclined planes (flat cams) 52*a*, 52*b*, and 52*c* (refer to FIGS. 8, 9, and 10A to 10C) on the side of the press section 50 working in a pair with the power transmission section 40, wherein the inclined planes 42*a* to 42*c* and 52*a* to 52*c* are brought into engagement with each other to move the press section 50 in a substantially perpendicular direction to the length of the twin-ring 1.

Figure 10A:
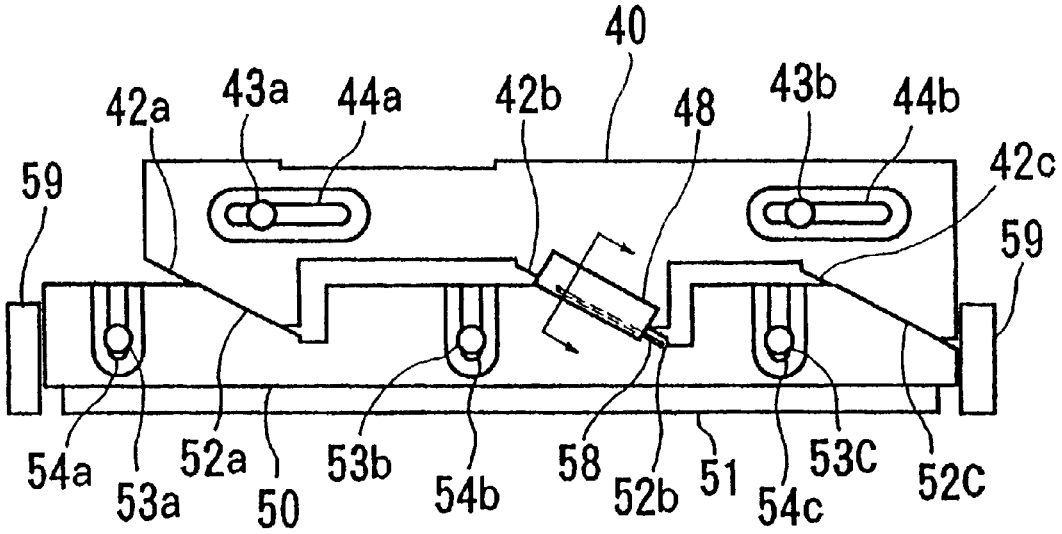
FIGS. 10A to 10C are diagrams showing the correlation between a power transmission section and a press section.
Figure 10B:
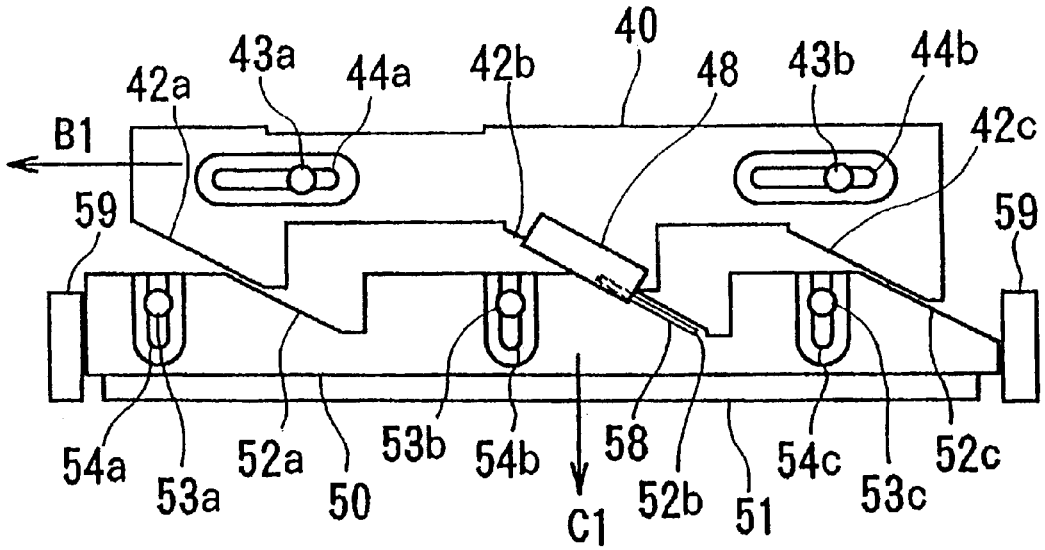
Figure 10C:
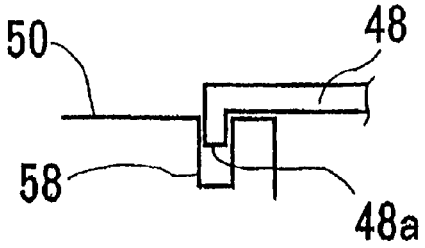

In other words, as shown in FIGS. 10A to 10C, the preferred embodiment of the present invention includes three combinations of the inclined planes 42*a* to 42*c* and 52*a* to 52*c* on the sides of the power transmission section 40 and the press section 50, respectively, from which power is transmitted to change the sliding direction of the power transmission section 40 and the sliding direction of the press section 50. Thus, the twin-ring 1 is pressurized substantially uniformly in full length between the anvil 21 and a press plane 51 at the rim of the press section 50 (refer to FIG. 7). However, the combinations of the inclined planes 42*a* to 42*c* and 52*a* to 52*c* are not limited to the three combinations, but may be configured of other combinations. In addition, the rack 41 and the engaging section 46 are omitted in FIGS. 10A to 10C.

In this case, preferably, as shown in FIGS. 10A and 10B, the power transmission section 40 slidable with respect to the base 20 of the bookbinding device 100 and the press section 50 are provided with slots (grooves) 44*a* and 44*b*, and 54*a* to 54*c*, respectively, in which rod members 43*a* and 43*b*, and 53*a* to 53*c* are secured to the base 20 of the bookbinding device 100, respectively, thereby sliding the power transmission section 40 while not being disengaged from the base 20, and the moving paths of the power transmission section 40 and the press section 50 are determined. Here, the lengths of the slots 44*a* and 44*b* and 54*a* to 54*c* correspond to the sliding directions of the power transmission section 40 and the press section 50, respectively.

Also, as shown in FIGS. 10A to 10C and FIG. 4, any one of the pair of inclined planes 42*a* to 42*c* and 52*a* to 52*c* is provided with a slot (groove) 58 and the other is provided with an interlocking section 48 having a claw (retaining section) 48*a* fitted into the slot 58 to thereby move the press section 50 in conjunction with the power transmission section 40 when the press section 50 is returned to the initial position (in the opposite direction to the arrow C1) and to ensure the prevention of the deviation between the pair of sliding inclined planes 42*a* to 42*c* and 52*a* to 52*c*. Here, FIG. 10C is a sectional view of the part, taken along the line c—c in FIG. 10A, and the slot 58 is formed along the inclination of the inclined plane 52*b* corresponding thereto. Also the combination of the interlocking section 48 and the groove 58, shown in FIG. 10C, is not necessarily limited to one set. The groove 58 and the corresponding claw 48*a* are not always formed at the upper parts of the power transmission section 40 and the press section 50, respectively, but may be formed on the sides or on the bottom (not shown) of the power transmission section 40 and the press section 50. Furthermore, the interlocking section 48 for connecting the power transmission section 40 and the press section 50 together may be configured using a link mechanism or the like (not shown).

As shown in FIGS. 10A and 10B, guides 59 extending in the same direction as the sliding direction of the press section 50 may be formed on both sides of the press section 50 sliding in a direction perpendicular to the length of the twin-ring 1 for determining the sliding direction of the press section 50 from both sides. However, when the press section 50 and the guides 59 are in contact with each other, it is preferable to make the friction at each contact surface minimum.

Figure 14:
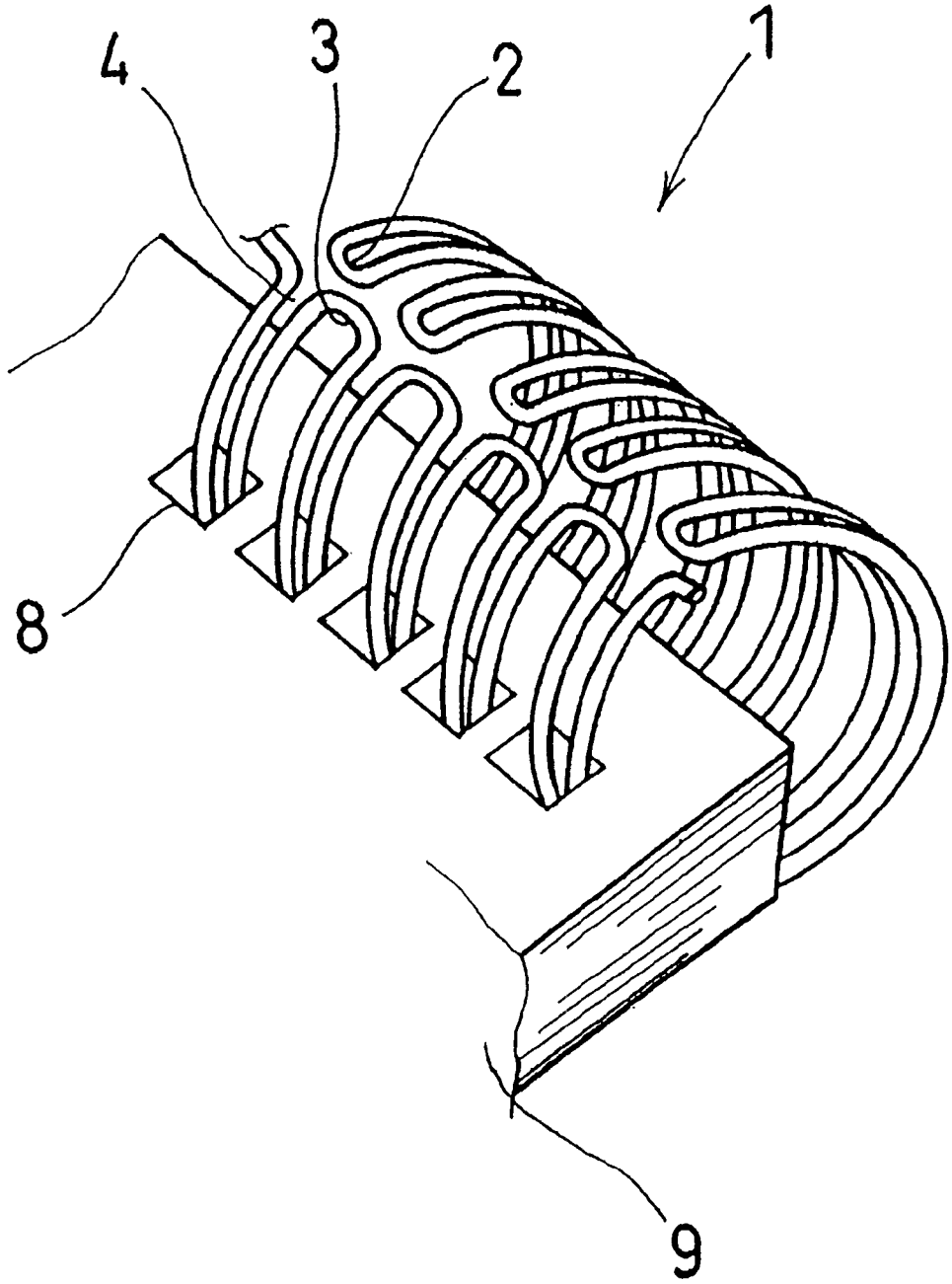
FIG. 14 is a perspective view of a twin-ring binding a plurality of sheets.

The bookbinding mechanism 90 according to the embodiment of the present invention is configured as described above, wherein when the operating section 30 is rotated clockwise (A1), as shown in FIG. 9, the power transmission section 40 integrated with the rack 41 is slid longitudinally (B1) along the length of the bookbinding device 100. At the same time, the press section 50 is slid in a direction (C1) substantially perpendicular to the length of the twin-ring 1 so as to be pushed out of the inclined planes 52*a* to 52*c* fitted to the inclined planes 42*a* to 42*c* by the inclined planes 42*a* to 42*c* of the power transmission section 40. Therefore, the press section 50 is slid to narrow the width of the groove 29, as shown by reference symbol d1 in FIG. 6 or 8 and reference symbol d2 in FIG. 7 or 9, to pressurize the twin-ring 1 between the press plane (iron plate) 51 at the rim of the press section 50 and the anvil 21 on the side of the groove 29, thereby deforming the section of the twin-ring 1 from a substantial C shape (refer to FIG. 6 or 13B) to a substantial O shape (refer to FIG. 7 or 13C) and binding the sheets 9 together, as shown in FIG. 14.

In the preferred embodiment of the present invention, the side of the base 20 is made of a metal plate (iron plate) of about 2 mm in thickness and the side is used as an anvil 21 (refer to FIG. 4). The reason why the base 20 is increased in thickness as described above is that when the twin-ring 1 is pressurized, a substantial force is applied to the anvil 21 backing the full length of the base 20. The base 20 and the anvil 21 may be formed of different members. Also, while the main body of the press section 50 is preferably formed of a relatively lightweight member such as plastic, it is preferable that the press plane 51 for directly pressurizing the twin-ring 1 be formed of a separate metallic member (iron plate). Additionally, the base 20 may also have a bottom 70 (refer to FIG. 4) thereunder to ensure the mounting of the lid 10 to the base 20.

The bookbinding device 100 according to the present invention is configured as describe above for twin-ring bookbinding. When the bookbinding operation is repeated after the completion of the bookbinding operation, the operating section 30 is rotated in the opposite direction from A1, thereby sliding the power transmission section 40 and the press section 50 in the opposite directions from B1 and C1, respectively, to move the bookbinding mechanism 90 to the start position again. Accordingly, the bookbinding operation of the bookbinding mechanism 90 can easily be performed continuously by the rotation of the operating section 30.

As seen from the above description, the present invention has advantages as follows: According to the first aspect of the present invention, the bookbinding device can be formed compact in its entirety, which is long in length along the length of the twin-ring and is short in length perpendicular to the length of the twin-ring, thus saving space for installation.

According to the first aspect of the present invention, when twin-rings of various diameters are pressure-deformed, a suitable compression amount can be determined in steps so as to prevent excess compression in each case.

According to the first aspect of the present invention, the twin-ring can quickly be inserted through the holes in the sheets by retaining the twin-ring to the substantially full length.

What is claimed is:

1. A bookbinding device used when stacking a plurality of sheets each having a plurality of holes punched in advance, and binding the plurality of sheets together by inserting a twin-ring through each of the holes and pressure-deforming the twin-ring, comprising:

an anvil;

a press section for pressurizing the twin-ring between said press section and the anvil;

a power transmission section for sliding the press section; and an operating section for sliding the power transmission section, wherein the power transmission section is moved along the length of the twin-ring; and the press section is moved in a direction perpendicular to the length of the twin-ring.

2. A bookbinding device according to claim 1, further comprising an adjusting section for determining in steps a sliding start position of the power transmission section.

3. A bookbinding device according to claim 1, further comprising a retaining section for retaining the twin-ring to the substantially full length of the side of the main body.

4. A bookbinding device according to claim 2, further comprising a retaining section for retaining the twin-ring to the substantially full length of the side of the main body.

* * * * *